US008415282B2

(12) United States Patent
Yagishita

(10) Patent No.: US 8,415,282 B2
(45) Date of Patent: Apr. 9, 2013

(54) LUBRICANT COMPOSITION

(75) Inventor: Kazuhiro Yagishita, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 0 days.

(21) Appl. No.: 11/663,760

(22) PCT Filed: Sep. 26, 2005

(86) PCT No.: PCT/JP2005/017632
§ 371 (c)(1),
(2), (4) Date: Mar. 7, 2008

(87) PCT Pub. No.: WO2006/035716
PCT Pub. Date: Apr. 6, 2006

(65) Prior Publication Data

US 2008/0318817 A1 Dec. 25, 2008

(30) Foreign Application Priority Data

Sep. 27, 2004 (JP) ..... 2004-280135

(51) Int. Cl.
*C10M 139/06* (2006.01)

(52) U.S. Cl. ..... 508/382

(58) Field of Classification Search ..... 508/287, 508/192, 382; 44/388
See application file for complete search history.

(56) References Cited

U.S. PATENT DOCUMENTS

| | | | | |
|---|---|---|---|---|
| 6,696,393 | B1 * | 2/2004 | Boffa | 508/287 |
| 2002/0002793 | A1 * | 1/2002 | Krull et al. | 44/388 |
| 2004/0038834 | A1 * | 2/2004 | Gahagan | 508/192 |

FOREIGN PATENT DOCUMENTS

| | | |
|---|---|---|
| JP | 6-100880 | 4/1994 |
| JP | 2001-200282 | 7/2001 |
| JP | 2001-262173 | 9/2001 |
| JP | 2002-20779 | 1/2002 |
| JP | 2002-294271 | 10/2002 |
| JP | 2003-277781 | 10/2003 |
| JP | 2004-68021 | 3/2004 |
| JP | 2004-83891 | 3/2004 |

* cited by examiner

*Primary Examiner* — James Goloboy
*Assistant Examiner* — Chantel Graham
(74) *Attorney, Agent, or Firm* — Finnegan, Henderson, Farabow, Garrett & Dunner, LLP

(57) ABSTRACT

The lubricating oil composition of the present invention comprises a base oil for lubricating oil, (A) at least one species selected from the phosphorus compounds represented by the following General Formula (1) or (2) as well as metal salts (excluding molybdenum salts) and amine salts thereof, and (B) an organic molybdenum compound not containing sulfur as a constituent element (in the formula, $R^1$ and $R^4$ represent hydrocarbon groups having 1 to 30 carbons, $R^2$, $R^3$, $R^5$ and $R^6$ represent hydrogen atoms or hydrocarbon groups having 1 to 30 carbons, $X^1$ to $X^7$ represent oxygen atoms or sulfur atoms, and n represents 0 or 1).

[Chemical formula 1]

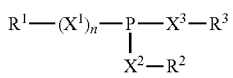

(1)

[Chemical formula 2]

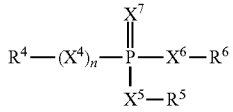

(2)

6 Claims, No Drawings

LUBRICANT COMPOSITION

TECHNICAL FIELD

The present invention relates to a lubricating oil composition, and specifically relates to a lubricating oil composition used suitably in applications such as lubricating oil for internal combustion engine.

BACKGROUND ART

In the field of lubricating oil used in applications such as internal combustion engine and automatic transmission, in recent years, from such points of view as efficient use of resources, decrease in waste oil and cost reduction for users of lubricating oil, requirements have increased regarding lubricating oils to have longer drain intervals. Thus, in prior art lubricating oils, suppression of deterioration of lubricating oils has been devised by mixing of various additives. For instance, in the case of a lubricating oil for internal combustion engine, the combined use of a sulfur-containing compound, such as, zinc dithiophosphate (ZDTP) or molybdenum dithiocarbamate (MoDTC), and a reaction chain terminator, such as, a phenol series or an amine series antioxidant, is generally considered to be effective from the point of oxidation stability, such that ZDTP is recognized broadly in general as an essential additive to be mixed in large amounts to some extent. In particular, deterioration of lubricating oil being pronounced in high output engines, such as, gas engines and direct injection engines, with high combustion temperatures and higher NOx gas concentrations contaminating the lubricating oil, the combined use of ZDTP and phenol series and/or amine series antioxidants is considered to be essential.

However, as the price to pay for decomposing peroxides, a sulfur-containing compound such as ZDTP may per se oxidize or thermally decompose and become the cause of acidic substance generation, such as of sulfuric acid, therefore, in lubricating oils for internal combustion engine, or the like, where metallic cleanser and ashless dispersant are mixed in general, it becomes a cause that triggers a decrease in base number, which is an indicator for acid neutralization property, and a decrease in cleaning properties at high temperature. Consequently, as long as large amounts of sulfur-containing compounds such as ZDTP are mixed, rendering [the oil] to have additionally longer drain intervals is extremely difficult to achieve.

On the other hand, in general, decreasing the quantity of metallic cleanser mixed in the lubricating oil is considered to be necessary in order to prevent ash deposition onto pistons of internal combustion engines, catalysts, such as, three-way catalysts, oxidation catalysts and NOx storage reduction type catalysts, or emission gas purification devices, such as, DPF; however, simply decreasing the quantity of mixed metallic cleanser compromises acid neutralization properties and cleaning properties at high temperature.

Furthermore, in regard to the above-mentioned catalysts, in particular the NOx storage reduction type catalyst, in order to decrease poisoning due to sulfur, studies on reducing sulfur content in fuels (for instance, light oil with a sulfur content of 50 mass ppm or less, gasoline with a sulfur content of 10 mass ppm or less, and the like) are proceeding rapidly, and the effects thereof are anticipated; however, in an internal combustion engine using such low sulfur fuels, the influence on the catalysts exerted by the sulfur content in the lubricating oil become relatively important. Consequently, a further increase in the amounts of sulfur-containing compounds in the lubricating oil is not desirable, and decreasing the sulfur content in the lubricating oil is essential.

Thus, studies were made to solve the above-mentioned problematic points in conventional lubricating oils and achieve sufficiently longer drain intervals. For instance, disclosed are, in Patent Reference 1, a lubricating oil composition in which a specific phosphorus compound has been mixed, in Patent Reference 2, a lubricating oil composition in which the content of ZDTP has been decreased and at the same time salicylate and sulfonate and a phosphorus-containing anti-wear agent are used in combination, and, in Patent Reference 3, a lubricating oil composition in which a specific phosphorus compound and a sulfur-containing organic molybdenum complex are used in combination, respectively.

[Patent Reference 1] Japanese Patent Application Laid-open No. 2002-294271

[Patent Reference 2] Japanese Patent Application Laid-open No. 2003-277781

[Patent Reference 3] Japanese Patent Application Laid-open No. 2004-83891

DISCLOSURE OF THE INVENTION

Problem the Invention is to Solve

The above lubricating oil compositions described in Patent References 1 to 3, allow remarkably longer drain intervals to be achieved compared to prior art lubricating oil in which ZDTP is mixed; however according to studies by the present inventors, even for these lubricating oil compositions, there is still room for improvement to raise, in a balanced and sufficient manner, the entirety of antioxidant properties, ability to maintain the base number, cleaning properties at high temperature and resistance against NOx.

The present invention was devised in view of this situation, and an object is to provide a lubricating oil composition allowing antioxidant properties, ability to maintain the base number, cleaning properties at high temperature and resistance against NOx to be achieved to a high level and in a balanced manner, in particular, having excellent resistance against NOx, and allowing a high level of long drain intervals to be realized in an application such as a lubricating oil for internal combustion engine.

Means for Solving the Problems

The present inventors undertook earnest studies to achieve the above objective, and as a result, discovered that the above issue is resolved by a lubricating oil composition using in combination a specific phosphorus compound and an organic molybdenum compound not containing sulfur as a constituent element, and reached completion of the present invention.

That is to say, the lubricating oil composition of the present invention comprises a base oil for lubricating oil, (A) at least one species selected from the phosphorus compound represented by the following General Formula (1) or (2) as well as metal salts (excluding molybdenum salts) and amine salts thereof (hereinafter, sometimes referred to as the (A) constituent), and (B) an organic molybdenum compound not containing sulfur as a constituent element (hereinafter, sometimes referred to as the (B) constituent),

[Chemical formula 1]

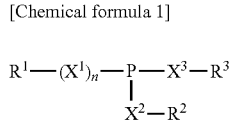

(1)

wherein $R^1$ represents a hydrocarbon group having 1 to 30 carbons, $R^2$ and $R^3$ may be identical or different, each representing a hydrogen atom or a hydrocarbon group having 1 to 30 carbons, $X^1$, $X^2$ and $X^3$ may be identical or different, each representing an oxygen atom or a sulfur atom, and n represents 0 or 1, at least one of $X^2$ and $X^3$ representing an oxygen atom when n represents 0, and at least one of $X^1$, $X^2$ and $X^3$ representing an oxygen atom when n represents 1,

[Chemical formula 2]

(2)

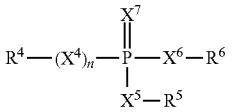

wherein $R^4$ represents a hydrocarbon group having 1 to 30 carbons, $R^5$ and $R^6$ may be identical or different, each representing a hydrogen atom or a hydrocarbon group having 1 to 30 carbons, $X^4$, $X^5$, $X^6$ and $X^7$ may be identical or different, each representing an oxygen atom or a sulfur atom, and n represents 0 or 1, at least two of $X^5$, $X^6$ and $X^7$ representing oxygen atoms when n represents 0, and at least three of $X^4$, $X^5$, $X^6$ and $X^7$ representing oxygen atoms when n represents 1. In the lubricating oil composition of the present invention, the combined use of the above (A) constituent and (B) constituent, allows antioxidant properties, ability to maintain the base number, cleaning properties at high temperature and resistance against NOx to be achieved to a high level and in a balanced manner, without combining a sulfur-containing peroxide decomposer and/or a specific metallic cleanser, and in particular, allows the resistance against NOx to be raised significantly.

In addition, the lubricating oil composition of the present invention can be used suitably in internal combustion engines for which low sulfur fuels are used, in particular fuels with a sulfur content of 100 mass ppm or less. That is to say, in an internal combustion engine using such a low sulfur fuel, the SOx fraction in the combustible gas can be decreased, not only sulfur poisoning against catalysts such as oxidation catalysts, three-way catalysts and NOx storage reduction type catalysts can be decreased, but also the mixing of SOx fraction into the lubricating oil can be decreased to prevent deterioration of lubricating oil. Therefore, by using the lubricating oil composition of the present invention that enables more sulfur content reduction than the prior art ZDTP mixed oil, sulfur poisoning originating from lubricating oil against the above catalysts can be further decreased, and in addition, oxidation stability, ability to maintain the base number, cleaning properties at high temperature and resistance against NOx can all be achieved at an extremely high level; therefore, using the lubricating oil composition of the present invention and a low sulfur fuel in an internal combustion engine, the merits thereof (emission gas cleaning, longer life span of catalysts and longer drain intervals of lubricating oil as well as, based thereon, decrease in cost/amount of waste oil and greater resource saving, and the like) can be fully exhibited.

In addition, the lubricating oil composition of the present invention preferably comprises at least one species selected from the phosphorus compounds represented by the following General Formula (3) or (4) and metal salts thereof (excluding molybdenum salts) as the (A) constituent. Phosphorus compounds represented by General Formula (3) or (4) are phosphorus compounds corresponding respectively to compounds in which $X^1$ to $X^3$ in the above General Formula (1) are oxygen atoms or $X^4$ to $X^7$ in (2) are oxygen atoms, and not containing sulfur as a constituent element. Using such phosphorus compounds and metal salts thereof (excluding molybdenum salts), the above effects of the present invention can be achieved at even higher levels.

[Chemical formula 3]

(3)

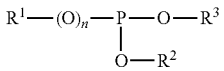

wherein $R^1$ represents a hydrocarbon group having 1 to 30 carbons, $R^2$ and $R^3$ may be identical or different, each representing a hydrogen atom or a hydrocarbon group having 1 to 30 carbons, and n represents 0 or 1,

[Chemical formula 4]

(4)

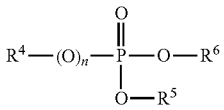

wherein $R^4$, $R^5$ and $R^6$ may be identical or different, each representing a hydrogen atom or a hydrocarbon group having 1 to 30 carbons, and n represents 0 or 1.

In addition, the lubricating oil composition of the present invention preferably comprises at least one species selected from molybdenum-amine complexes, molybdenum salts of organic acids and molybdenum salts of alcohols as the (B) constituent.

In addition, as long as the effects of the present invention are not inhibited notably, various additives containing sulfur as a constituent element can be included in the lubricating oil composition of the present invention, the content thereof being preferably 0.1% by mass or less when converted to sulfur element with the total amount of the composition as reference. Herein, "additive containing sulfur as a constituent element" include sulfur-containing anti-wear agents, such as, phosphorus compounds where a portion or the entirety of $X^1$ to $X^7$ is a sulfur atom in the above General Formula (1) or (2), or metal salts or amine salts thereof, ZDTP, metal salts of dithiophosphoric acid, dithiocarbamate or metal salts thereof, sulfide oil fat, disulphides, sulfide olefins, and the like. In addition, these additives containing sulfur are sometimes mixed as a mixture of carrier oil or the like, "the content of additive containing sulfur as a constituent element" means the content of effective ingredient excluding the carrier oil and the like. Furthermore, "the content of additive containing sulfur as a constituent element being preferably 0.1% by mass or less when converted to sulfur element with the total amount of the composition as reference" means the total amount of sulfur contained in the base oil for lubricating oil constituting the lubricating oil composition of the present invention and the constituents of the additive other than carrier oil is 0.1% by mass or less when converted in sulfur element with the total amount of the composition as reference, and, in other words, the value (unit: % by mass) represented by [(sulfur content in the entire composition)−(sulfur content originating from base oil for lubricating oil and carrier oil)].

In addition, in the lubricating oil composition of the present invention, the sulfur content of the base oil for lubricating oil is preferably 0.005% by mass or less with the total amount of the base oil for lubricating oil as reference. Using a base oil for lubricating oil having a sulfur content of 0.005% by mass or less, the above effects of the present invention can be achieved at even higher levels.

Note that, "sulfur content" referred to in the present invention means a value measured according to, JIS K 2541-4 "Energy-dispersive X-ray fluorescence method" (in general, a range of 0.01 to 5% by mass) or JIS K 2541-5 "Pump Mass Determination Method, Appendix (Regulations), Inductively Coupled Plasma Spectrophotometry" (in general, 0.05% by mass or greater), and the content converted to sulfur element for an additive containing sulfur as a constituent element is determined by measuring respectively [sulfur content in the entire lubricating oil composition] and [sulfur content originating from base oil for lubricating oil and carrier oil], and subtracting the latter measurement value from the former measurement value. In addition, as a method to determine directly the sulfur content of the additive containing sulfur as a constituent element, there is the method of separating the effective ingredient of the additive from the lubricating oil and carrier oil, and measuring the sulfur content for the effective ingredient according to the above method.

Note that the effective ingredient in the lubricating oil composition or the additive can be separated from the base oil for lubricating oil and carrier oil, by conventional methods such as rubber membrane dialysis and chromatography (for instance, refer to Yagishita et. al., Nippon Mitsubishi Oil review Volume 41, No. 4, pp 25-34 (issued October 1999)). In addition, if the sulfur content is no greater than the conventional measuring limits of the above methods, it can be determined from a calibration curve obtained by measuring standards at suitably modified concentrations.

Effects of the Invention

According to the present invention, antioxidant properties, ability to maintain the base number, cleaning properties at high temperature and resistance against NOx can be achieved in a balanced manner at a high level, in particular, resistance against NOx is extremely good, without using a sulfur-containing peroxide decomposer effective in resisting against NOx, and in addition, without the combined use of such specific metallic cleanser as in Patent Reference 2. Consequently, also when the lubricating oil composition of the present invention is used in internal combustion engines using a low sulfur fuel and internal combustion engines fitted with an emission gas cleaning apparatus, or internal combustion engines with high NOx concentrations (gas engine and the like), it can display extremely good long drain intervals properties, and in particular in internal combustion engines using low sulfur fuel and fitted with a emission gas cleaning apparatus, the merits thereof (emission gas cleaning, extending the life span of the catalyst and longer drain intervals for the lubricating oil, as well as decrease in the costs/amount of waste oil and resource conservation based thereupon, and the like) can be fully displayed.

BEST MODE FOR CARRYING OUT THE INVENTION

Hereinafter, the preferred embodiments of the present invention will be described in detail.

Mineral oil series base oils or synthetic series base oils employed in conventional lubricating oils can be used as base oils for lubricating oil used in the lubricating oil composition of the present invention, with no particular limitation.

Concretely, those [oils] obtained by distillation at ordinary pressure of crude oil, subjecting the ordinary pressure residual oil obtained to distillation at reduced pressure, and subjecting the obtained lubricating oil fraction to purification by carrying out one or more treatments, such as, solvent desasphalting, solvent extraction, hydrogenolysis, solvent dewaxing and hydrogenation purification, or wax isomerized mineral oils and base oils prepared by methods whereby a GTL WAX (gas-to-liquid wax) is isomerized, and the like, can be given as examples of mineral oil series base oils.

In addition, although the sulfur content in the mineral oil series base oil is not limited in particular, it is preferably 0.1% by mass or less, more preferably 0.05% by mass or less, even more preferably 0.01% by mass or less, and particularly preferably 0.005% by mass or less. By decreasing the sulfur content of the mineral oil series base oil in this way, a low sulfur lubricating oil composition can be obtained, with better long drain intervals properties, and, when used as lubricating oil for internal combustion engine, allowing detrimental effects on emission gas post-processing device to be avoided as much as possible.

As synthetic series base oils, concretely, polybutene or hydrides thereof; poly-α-olefins such as 1-octene oligomer and 1-decene oligomer, or hydrides thereof; ditridecyl glutarate, di-2-ethyl hexyl adipate, diesters such as diisodecyl adipate, ditridecyl adipate and di-2-ethyl hexyl sebacate; polyol esters such as neopentyl glycol ester, trimethylol propane caprylate, trimethylol propane pelargonate, pentaerythritol-2-ethyl hexanoate and pentaerythritol pelargonate; aromatic series synthetic oils such as alkyl naphthalene, alkyl benzene and aromatic esters, or mixtures thereof, and the like, can be given as examples.

In the present invention, among the above mineral oil series base oils or the above synthetic series base oils, one species may be used alone, or two or more species may be used in combination. Mixed base oils combining two or more species of base oils for lubricating oil include mixed base oils with two or more species of mineral oil series base oils, mixed base oils with two or more species of synthetic series base oils, and mixed base oils with one or more species of mineral oil series base oils and one or more species of synthetic series base oils.

Although the kinematic viscosity of the base oil for lubricating oil is not limited in particular, the kinematic viscosity thereof at 100° C., is preferably 20 $mm^2/s$ or less, and more preferably 10 $mm^2/s$ or less. Meanwhile, the kinematic viscosity thereof is preferably 1 $mm^2/s$ or greater, and more preferably 2 $mm^2/s$ or greater. If the kinematic viscosity at 100° C. of the base oil for lubricating oil exceeds 20 $mm^2/s$, the low temperature viscosity characteristic deteriorates, on the other hand, if the kinematic viscosity thereof is less than 1 $mm^2/s$, as oil film formation is insufficient at the lubrication spot, lubricity becomes poor and loss of base oil for lubricating oil by evaporation becomes important, both of which are undesirable.

In addition, the amount of base oil for lubricating oil lost by evaporation, in terms of NOACK evaporation amount, is preferably 20% by mass or less, more preferably 16% by mass or less, and particularly preferably 10% by mass or less. A NOACK evaporation amount exceeding 20% by mass for the base oil for lubricating oil is not desirable, since not only the evaporation loss of the lubricating oil is important, there is the risk that sulfur compound and phosphorus compound, or the metal fraction within the composition, along with the base oil for lubricating oil, deposit in the emission gas cleaning apparatus when used as a lubricating oil for internal combustion engine, and detrimental effects on emission gas cleaning ability are feared. Note that NOACK evaporation amount referred to herein is measured according to ASTM D5800t.

In addition, the viscosity index of the base oil for lubricating oil is in general 200 or less with no particular limitation;

however, in order to obtain excellent viscosity characteristics from a low temperature to a high temperature, the value thereof is preferably 80 or greater, more preferably 100 or greater, and even more preferably 120 or greater. If the viscosity index of the base oil for lubricating oil is less than 80, the low temperature viscosity characteristics tend to deteriorate. In addition, the viscosity index of the base oil for lubricating oil is preferably 160 or less.

The (A) constituent in the lubricating oil composition of the present invention is at least one species of compound (phosphorus-containing anti-wear agent) selected from the phosphorus compound represented by General Formula (1), the phosphorus compound represented by the General Formula (2), and metal salts or amine salts thereof (however, molybdenum salts are excluded).

[Chemical formula 5]

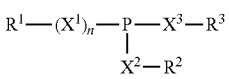

(1)

wherein $R^1$ represents a hydrocarbon group having 1 to 30 carbons, $R^2$ and $R^3$ may be identical or different, each representing a hydrogen atom or a hydrocarbon group having 1 to 30 carbons, $X^1$, $X^2$ and $X^3$ may be identical or different, each representing an oxygen atom or a sulfur atom, n represents 0 or 1, at least one of $X^2$ and $X^3$ representing an oxygen atom when n represents 0, and at least one of $X^1$, $X^2$ and $X^3$ representing an oxygen atom when n represents 1,

[Chemical formula 6]

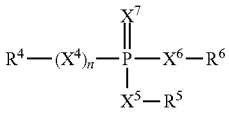

(2)

wherein $R^4$ represents a hydrocarbon group having 1 to 30 carbons, $R^5$ and $R^6$ may be identical or different, each representing a hydrogen atom or a hydrocarbon group having 1 to 30 carbons, $X^4$, $X^5$, $X^6$ and $X^7$ may be identical or different, each representing an oxygen atom or a sulfur atom, n represents 0 or 1, at least two of $X^5$, $X^6$ and $X^7$ representing oxygen atoms when n represents 0, and at least three of $X^4$, $X^5$, $X^6$ and $X^7$ representing oxygen atoms when n represents 1.

In the above General Formulae (1) and (2), as the hydrocarbon groups having 1 to 30 carbons represented by $R^1$ to $R^6$, concretely, alkyl groups, cycloalkyl groups, alkenyl groups, alkyl-substituted cycloalkyl groups, aryl groups, alkyl-substituted aryl groups, and aryl alkyl groups can be cited.

As the above alkyl groups, for instance, alkyl groups such as methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, and octadecyl group (these alkyl groups may be linear or branched) can be cited.

As the above cycloalkyl groups, for instance, cycloalkyl groups having 5 to 7 carbons, such as, cyclopentyl group, cyclohexyl group and cycloheptyl group can be cited. In addition, as the above alkyl cycloalkyl groups, for instance, alkyl cycloalkyl groups having 6 to 11 carbons, such as, methyl cyclopentyl group, dimethyl cyclopentyl group, methyl ethyl cyclopentyl group, diethyl cyclopentyl group, methyl cyclohexyl group, dimethyl cyclohexyl group, methyl ethyl cyclohexyl group, diethyl cyclohexyl group, methyl cycloheptyl group, dimethyl cycloheptyl group, methyl ethyl cycloheptyl group and diethyl cycloheptyl group (the position of alkyl group substitution onto the cycloalkyl group is also arbitrary) can be cited.

As the above alkenyl groups, for instance, alkenyl groups such as butenyl group, pentenyl group, hexenyl group, heptenyl group, octenyl group, nonenyl group, decenyl group, undecenyl group, dodecenyl group, tridecenyl group, tetradecenyl group, pentadecenyl group, hexadecenyl group, heptadecenyl group and octadecenyl group (these alkenyl groups may be linear or branched; in addition, the position of the double-bond is also arbitrary) can be cited.

As the above aryl groups, for instance, aryl groups such as phenyl group and naphthyl group can be cited. In addition, as the above alkyl aryl groups, for instance, alkyl aryl groups having 7 to 18 carbons, such as, tolyl group, xylyl group, ethyl phenyl group, propyl phenyl group, butyl phenyl group, pentyl phenyl group, hexyl phenyl group, heptyl phenyl group, octyl phenyl group, nonyl phenyl group, decyl phenyl group, undecyl phenyl group and dodecyl phenyl group (the alkyl groups may be linear or branched; in addition, the substitution position on the aryl group is arbitrary) can be cited.

As the above aryl alkyl groups, for instance, aryl alkyl groups having 7 to 12 carbons, such as, benzyl group, phenylethyl group, phenyl propyl group, phenyl butyl group, phenyl pentyl group and phenyl hexyl group (these alkyl groups may be linear or branched) can be cited.

The above hydrocarbon groups having 1 to 30 carbons represented by $R^1$ to $R^6$ are preferably alkyl groups having 1 to 30 carbons or aryl groups having 6 to 24 carbons, more preferably alkyl groups having 3 to 18 carbons, and more preferably having 4 to 12 carbons.

As the phosphorus compounds represented by General Formula (1), for instance, phosphorous monoesters, mono thio phosphorous monoesters, (hydrocarbyl)phosphonous acids and (hydrocarbyl)mono thio phosphonous acids having one of the above-mentioned hydrocarbon group having 1 to 30 carbons; phosphorous diesters, mono thio phosphorous diesters, (hydrocarbyl)phosphonous acid monoesters and (hydrocarbyl)mono thio phosphonous acid monoesters having two of the above-mentioned hydrocarbon groups having 1 to 30 carbons; phosphorous triesters, mono thio phosphorous triesters, (hydrocarbyl)phosphonous acid diesters and (hydrocarbyl)mono thio phosphonous acid diesters having three of the above-mentioned hydrocarbon groups having 1 to 30 carbons; and mixtures thereof, or the like, may be cited.

In the present invention, the compound represented by General Formula (1) is preferably a compound where $X^1$ to $X^3$ are entirely oxygen atoms, that is to say, a compound represented by the following General Formula (3).

[Chemical formula 7]

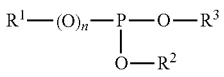

(3)

wherein $R^1$ represents a hydrocarbon group having 1 to 30 carbons, $R^2$ and $R^3$ may be identical or different, each representing a hydrogen atom or a hydrocarbon group having 1 to 30 carbons, and n represents 0 or 1.

As the phosphorus compounds represented by General Formula (2), for instance, monoesters of phosphoric acid, monoesters of monothiophosphoric acid, (hydrocarbyl)phosphonic acids and (hydrocarbyl)monothiophosphonic acids having one of the above-mentioned hydrocarbon group having 1 to 30 carbons; diesters of phosphonic acid, diesters of monothio phosphonic acid, monoesters of (hydrocarbyl) phosphonic acid and monoesters of (hydrocarbyl)monothiophosphonic acid having two of the above-mentioned hydrocarbon groups having 1 to 30 carbons; triesters of phosphoric acid, triesters of monothiophosphoric acid, diesters of (hydrocarbyl)phosphonic acid and diesters of (hydrocarbyl) monothiophosphonic acid having three of the above-mentioned hydrocarbon groups having 1 to 30 carbons; and mixtures thereof, or the like, may be cited.

In the present invention, the compound represented by General Formula (2) is preferably a compound where $X^4$ to $X^7$ are entirely oxygen atoms, that is to say, a compound represented by the following General Formula (4).

[Chemical formula 8]

(4)

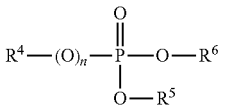

wherein $R^4$, $R^5$ and $R^6$ may be identical or different, each representing a hydrogen atom or a hydrocarbon group having 1 to 30 carbons, and n represents 0 or 1.

In addition, metal salts or amine salts of the phosphorus compound represented by General Formula (1) or (2) can be obtained by action, onto the phosphorus compound represented by General Formula (1) or (2), of a metallic base, such as, metallic oxide, metallic hydroxide, metallic carbonate and metallic chloride, a nitrogen compound, such as, ammonia, amine compounds having within the molecule only a hydrocarbon group having 1 to 30 carbons or a hydroxyl group-containing hydrocarbon group, and the like, and neutralization of part or the entirety of the remaining acidic hydrogens.

As metals in the above metallic bases, concretely, alkali metals such as lithium, sodium, potassium and cesium, alkaline earth metals such as calcium, magnesium and barium, heavy metals such as zinc, copper, iron, lead, nickel, silver and manganese (however, molybdenum is excluded), and the like, may be cited. Among these, alkaline earth metals such as calcium and magnesium, and zinc are preferred, and zinc is particularly preferred.

Note that the metal salts of the above phosphorus compound have different structures depending on the valence of the metal or the number of OH groups or SH groups in the phosphorus compound, therefore, the structure of the metal salt of the phosphorus compound is not restricted in any way. For instance, although it is believed that when 1 mol of zinc oxide is reacted with 2 mol of diester of phosphonic acid (a compound having one OH group), a compound having the structure represented by the following Formula (5) is obtained as the principal component, it is also believed that a polymerized molecule is also present.

[Chemical formula 9]

(5)

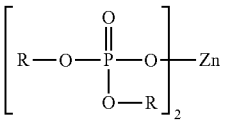

wherein R represents respectively independently a hydrogen atom or a hydrocarbon group having 1 to 30 carbons.

In addition, for instance, although it is believed that when 1 mol of zinc oxide and 1 mol of phosphoric acid monoester (a compound with two OH groups) are reacted, a compound having the structure represented by the following Formula (6) is obtained as the principal component, it is also believed that a polymerized molecule is also present.

[Chemical formula 10]

(6)

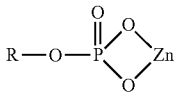

wherein R represents a hydrogen atom or a hydrocarbon group having 1 to 30 carbons.

In addition, as the above nitrogen compounds, concretely, ammonia, monoamines, diamines and polyamines may be cited. More concretely, alkyl amines having an alkyl group having 1 to 30 carbons, such as, methyl amine, ethyl amine, propyl amine, butyl amine, pentyl amine, hexyl amine, heptyl amine, octyl amine, nonyl amine, decyl amine, undecyl amine, dodecyl amine, tridecyl amine, tetradecyl amine, pentadecyl amine, hexadecyl amine, heptadecyl amine, octadecyl amine, dimethylamine, diethyl amine, dipropyl amine, dibutyl amine, dipentyl amine, dihexyl amine, diheptyl amine, dioctyl amine, dinonyl amine, didecyl amine, diundecyl amine, didodecyl amine, ditridecyl amine, ditetradecyl amine, dipentadecyl amine, dihexadecyl amine, diheptadecyl amine, dioctadecyl amine, methyl ethyl amine, methyl propyl amine, methyl butyl amine, ethyl propyl amine, ethyl butyl amine and propyl butyl amine (these alkyl group may be linear or branched); alkenyl amines having an alkenyl group having 2 to 30 carbons, such as, etenyl amine, propenyl amine, butenyl amine, octenyl amine and oleyl amine (these alkenyl groups may be linear or branched); alkanol amines having an alkanol group having 1 to 30 carbons, such as, methanol amine, ethanol amine, propanol amine, butanol amine, pentanol amine, hexanol amine, heptanol amine, octanol amine, nonanol amine, methanol ethanolamine, methanol propanol amine, methanol butanol amine, ethanol propanol amine, ethanol butanol amine and propanol butanol amine (these alkanol groups may be linear or branched); alkylene diamines having an alkylene group having 1 to 30 carbons, such as, methylene diamine, ethylene diamine, propylene diamine and butylene diamine; polyamines such as diethylene triamine, triethylene tetramine, tetraethylene pentamine and pentaethylene hexamine; compounds having an alkyl group or an alkenyl group having 8 to 20 carbons on the above monoamines, diamines and polyamines, such as, undecyl diethyl amine, undecyl diethanol amine, dodecyl dipropanol amine, oleyl diethanol amine, oleyl propylene diamine and stearyl tetraethylene pentamine, and heterocyclic compounds such as N-hydroxyethyl oleyl imidazoline; alkylene oxide adducts of these compounds; and mixtures thereof, or the like, can be given as examples.

Among these nitrogen compounds, aliphatic amines having an alkyl group or an alkenyl group having 10 to 20 carbons, such as, decyl amine, dodecyl amine, tridecyl amine, heptadecyl amine, octadecyl amine, oleyl amine and stearyl amine (these may be linear or branched) can be given as preferred examples.

In the present invention, the above-mentioned phosphorus compounds as well as metal salts thereof (excluding molybdenum salts) as the (A) constituent, may be used alone, and may be used by combining two or more species.

As the (A) constituent according to the present invention, phosphorus compounds represented by the above-mentioned General Formula (3) or (4), or metal salts thereof (excluding molybdenum salts), are preferred, among which, salts of phosphorous diesters having two alkyl groups or aryl groups having 3 to 18 carbons and zinc or calcium, salts of phosphorous triesters having three alkyl groups or aryl groups having 3 to 18 carbons, preferably alkyl groups having 6 to 12 carbons, phosphoric acid monoester having one alkyl group or aryl group having 3 to 18 carbons and zinc or calcium, salt of phosphoric acid diester having two alkyl group or aryl group having 3 to 18 carbons and zinc or calcium, or phosphoric acid triesters having three alkyl groups or aryl groups having 3 to 18 carbons, and preferably alkyl groups having 6 to 12 carbons, salts of (hydrocarbyl)phosphonous acid having one alkyl group or aryl group having 1 to 18 carbons and zinc or calcium, salts of (hydrocarbyl)phosphonous acid monoesters having two alkyl groups or aryl groups having 1 to 18 carbons and zinc or calcium, (hydrocarbyl)phosphonous acid diesters having three alkyl groups or aryl groups having 1 to 18 carbons, salts of (hydrocarbyl)phosphonic acid having one alkyl group or aryl group having 1 to 18 carbons and zinc or calcium, salts of (hydrocarbyl)phosphonic acid monoester having two alkyl groups or aryl groups having 1 to 18 carbons and zinc or calcium, (hydrocarbyl)phosphonic acid diesters having three alkyl groups or aryl groups having 1 to 18 carbons are preferred.

As the above (hydrocarbyl)phosphonic(nous) acids, metal salts thereof, (hydrocarbyl)phosphonic(nous) acid monoesters, metal salts thereof, as well as (hydrocarbyl) phosphonic(nous) acid diesters, the total number of carbons of the hydrocarbon groups is preferably 12 to 30 from the points of oil solubility and extreme pressure properties, more preferably 14 to 24, and even more preferably 16 to 20.

In the lubricating oil composition of the present invention, the (A) constituent content converted into phosphorus element with the total amount of the composition as the reference, is preferably 0.005% by mass or greater, more preferably 0.01% by mass or greater, even more preferably 0.02% by mass or greater, and preferably 0.5% by mass or less, more preferably 0.2% by mass or less, even more preferably 0.1% by mass or less, and particularly preferably 0.08% by mass or less. If the (A) constituent content converted into phosphorus element is less than 0.005% by mass, anti-wear properties become insufficient, longer drain intervals tend to be difficult to achieve. On the other hand, even if the (A) constituent content converted into phosphorus element exceeds 0.5% by mass, the above improvement effects tend not to be obtained commensurate to the increase in the content, and in addition, when the lubricating oil composition of the present invention is used as a lubricating oil for internal combustion engine, detrimental effects of phosphorus on the emission gas post-processing device is feared. From the point of the ability to decrease notably the influence on the emission gas post-processing device, the (A) constituent content converted into phosphorus element is preferably 0.08% by mass or less, in particular 0.05% by mass or less.

Note that, among the above-mentioned (A) constituents in the present invention, regarding the compounds containing sulfur, inclusion is also within the limits of the above amount of phosphorus element, and the compound content converted into amount of sulfur element is preferably 0.1% by mass or less, and more preferably 0.08% by mass or less. Then, the lubricating oil composition of the present invention most preferably does not comprise a compound containing sulfur as the (A) constituent, that is to say, the (A) constituent is constituted solely by the phosphorus compounds represented by General Formula (3) or (4), or metal salts (excluding molybdenum salts) or amine salts thereof.

The (B) constituent according to the present invention is an organic molybdenum compound not containing sulfur as a constituent element. As the (B) constituent, concretely, molybdenum-amine complexes, molybdenum-succinimide complexes, molybdenum salts of organic acids, molybdenum salts of alcohols, and the like, may be cited, among which, molybdenum-amine complexes, molybdenum salts of organic acids and molybdenum salts of alcohols are preferred.

As the molybdenum compound constituting the above-mentioned molybdenum-amine complexes, molybdenum compounds not containing sulfur may be cited, such as, molybdenum trioxide or hydrates thereof ($MoO_3/nH_2O$), molybdic acid ($H_2MoO_4$), alkali metal salts of molybdic acid ($M_2MoO4$; M represents an alkali metal salt), ammonium molybdate ($(NH_4)2MoO_4$ or $(NH_4)_6[Mo_7O_{24}]/4H_2O$), $MoCl_5$, $MoOCl_4$, $MoO_2Cl_2$, $MoO_2Br_2$ and $Mo_2O_3Cl_6$. Among these molybdenum compounds, from the point of yield of molybdenum-amine complexes, hexavalent molybdenum compounds are preferred. Furthermore, from the point of availability, among the hexavalent molybdenum compounds, molybdenum trioxide or hydrates thereof, molybdic acid, alkali metal salts of molybdic acid, and ammonium molybdate are preferred.

In addition, as amine compounds constituting the molybdenum-amine complexes, the monoamines, diamines, polyamines and alkanol amines given as examples in the description of amine salts of phosphorus compounds as the (A) constituent can be respectively given as examples, with no particular limitations, among which primary amines, secondary amines and alkanol amines are preferred.

The number of carbons of the hydrocarbon groups on the amine compound constituting the molybdenum-amine complexes is preferably 4 or greater, more preferably 4 to 30, and particularly preferably 8 to 18. If the number of carbons of the hydrocarbon group of the amine compound is less than 4, the solubility tends to deteriorate. In addition, by letting the number of carbons of the amine compound to be 30 or less, the amount of molybdenum in the molybdenum-amine complexes can be increased relatively, enabling a higher increase of the effects of the present invention by mixing small amounts.

In addition, as molybdenum-succinimide complexes, complexes of a molybdenum compound not containing sulfur such as those given as examples in the description of the above molybdenum-amine complexes and a succinimide having an alkyl group or an alkenyl group having 4 carbons or more may be cited. As succinimide, the (D-1) constituent mentioned in the (D) constituent section, succinimides having an alkyl group or an alkenyl group having 4 to 39 carbons, preferably having 8 to 18 carbons, and the like, may be cited. If the number of carbons of the alkyl group or the alkenyl group in the succinimide is less than 4, the solubility tends to deteriorate. In addition, although succinimides having an alkyl group or an alkenyl group having a number of carbon exceeding 30 and no greater than 400 can also be used, by letting the number of carbons of the alkyl group or the alkenyl group to be 30 or less, the amount of molybdenum in the molybdenum-succinimide complexes can be increased relatively, enabling a higher increase of the effects of the present invention by mixing small amounts.

In addition, as molybdenum salts of organic acids, salts of molybdenum bases such as molybdenum oxides or molybdenum hydroxides given as examples in the description of the above molybdenum-amine complexes, molybdenum carbonate or molybdenum chloride, and an organic acid, may be cited. As organic acids, the phosphorus compounds and carboxylic acids represented by the above-mentioned General Formula (3) or (4) are preferred. Herein, regarding the preferred modes for General Formulae (3) and (4) in the molybdenum salts of the phosphorus compounds represented by General Formula (3) or (4), they can be the same as in the case of the (A) constituent.

In addition, as carboxylic acids constituting the molybdenum salts of carboxylic acid, they may be either monobasic acids or polybasic acids.

As monobasic acids, fatty acids having a number of carbons of in general 2 to 30, and preferably 4 to 24, are used, and these fatty acid may be linear or branched, and in addition, may be saturated or unsaturated. Concretely, for instance, saturated fatty acids, such as, acetic acid, propionic acid, linear or branched butanoic acid, linear or branched pentanoic acid, linear or branched hexanoic acid, linear or branched heptanoic acid, linear or branched octanoic acid, linear or branched nonanoic acid, linear or branched decanoic acid, linear or branched undecanoic acid, linear or branched dodecanoic acid, linear or branched tridecanoic acid, linear or branched tetradecanoic acid, linear or branched pentadecanoic acid, linear or branched hexadecanoic acid, linear or branched heptadecanoic acid, linear or branched octadecanoic acid, linear or branched hydroxy octadecanoic acid, linear or branched nonadecanoic acid, linear or branched icosanoic acid, linear or branched henicosanoic acid, linear or branched docosanoic acid, linear or branched tricosanoic acid and linear or branched tetracosanoic acid, unsaturated fatty acids, such as, acrylic acid, linear or branched butenoic acid, linear or branched pentenoic acid, linear or branched hexenoic acid, linear or branched heptenoic acid, linear or branched octenoic acid, linear or branched nonenoic acid, linear or branched decenoic acid, linear or branched undecene acid, linear or branched dodecenoic acid, linear or branched tridecenoic acid, linear or branched tetradecenoic acid, linear or branched pentadecenoic acid, linear or branched hexadecenoic acid, linear or branched heptadecenoic acid, linear or branched octadecenoic acid, linear or branched hydroxy octadecenoic acid, linear or branched nonadecenoic acid, linear or branched icosenoic acid, linear or branched henicosenoic acid, linear or branched docosenoic acid, linear or branched tricosenoic acid, linear or branched tetracosenoic acid, and mixtures thereof, or the like, may be cited.

In addition, as monobasic acids, other than the above fatty acids, monocyclic or polycyclic carboxylic acids (may have a hydroxyl group) may be used, the number of carbons thereof being preferably 4 to 30, and more preferably 7 to 30. As monocyclic or polycyclic carboxylic acids, aromatic carboxylic acids or cycloalkyl carboxylic acids having 0 to 3, and preferably 1 to 2 linear or branched alkyl groups having 1 to 30 carbons, and preferably having 1 to 20 carbons, and the like, may be cited, and more concretely, (alkyl)benzene carboxylic acid, (alkyl)naphthalene carboxylic acid, (alkyl)cycloalkyl carboxylic acid, and the like, can be given as examples. As preferred examples of monocyclic or polycyclic carboxylic acids, benzoic acid, salicylic acid, alkyl benzoic acid, alkyl salicylic acid, cyclohexane carboxylic acid, and the like, may be cited.

In addition, as polybasic acids, dibasic acids, tribasic acids, tetrabasic acids, and the like, may be cited. The polybasic acids may be either chain polybasic acid or circular polybasic acids. In addition, in the case of a chain polybasic acid, it may be either linear or branched, and in addition, may be either saturated or unsaturated. As chain polybasic acids, chain dibasic acids having 2 to 16 carbons are preferred, and concretely, for instance, ethane dioic acid, propane dioic acid, linear or branched butane dioic acid, linear or branched pentane dioic acid, linear or branched hexane dioic acid, linear or branched heptane dioic acid, linear or branched octane dioic acid, linear or branched nonane dioic acid, linear or branched decane dioic acid, linear or branched undecane dioic acid, linear or branched dodecane dioic acid, linear or branched tridecane dioic acid, linear or branched tetradecane dioic acid, linear or branched heptadecane dioic acid, linear or branched hexadecane dioic acid, linear or branched hexene dioic acid, linear or branched heptene dioic acid, linear or branched octene dioic acid, linear or branched nonene dioic acid, linear or branched decene dioic acid, linear or branched undecene dioic acid, linear or branched dodecene dioic acid, linear or branched tridecene dioic acid, linear or branched tetradecene dioic acid, linear or branched heptadecene dioic acid, linear or branched hexadecene dioic acid, alkenyl succinic acid and mixtures thereof, or the like, may be cited. In addition, as circular polybasic acids, alicyclic dicarboxylic acids [such as] 1,2-cyclohexane dicarboxylic acid and 4-cyclohexene-1,2-dicarboxylic acid, aromatic dicarboxylic acids such as phthalic acid, aromatic tricarboxylic acids such as trimellitic acid, aromatic tetracarboxylic acids such as pyromellitic acid, and the like, may be cited.

In addition, as the above-mentioned molybdenum salts of alcohols, salts of molybdenum compound not containing sulfur given as examples in the description of the above molybdenum-amine complexes, and an alcohol, the alcohol may be any among a monoalcohol, a polyalcohol, a partial ester or a partial ester compound of a polyalcohol, a nitrogen compound having a hydroxyl group (alkanol amine and the like) and the like. Note that molybdic acid is a strong acid and forms an ester by reaction with an alcohol, and the ester of molybdic acid and alcohol is also included in the molybdenum salts of alcohols referred to in the present invention.

As monoalcohols, those with a number of carbons of in general 1 to 24, preferably 1 to 12, and more preferably 1 to 8 are used, as such alcohols, they may be linear or branched, and in addition, may be saturated or may be unsaturated. As alcohols having 1 to 24 carbons, concretely, for instance, methanol, ethanol, linear or branched propanol, linear or branched butanol, linear or branched pentanol, linear or branched hexanol, linear or branched heptanol, linear or branched octanol, linear or branched nonanol, linear or branched decanol, linear or branched undecanol, linear or branched dodecanol, linear or branched tridecanol, linear or branched tetradecanol, linear or branched pentadecanol, linear or branched hexadecanol, linear or branched heptadecanol, linear or branched octadecanol, linear or branched nonadecanol, linear or branched icosanol, linear or branched henicosanol, linear or branched tricosanol, linear or branched tetracosanol and mixtures thereof, or the like, may be cited.

In addition, as polyalcohols, those that are in general di- to deca-, and preferably di- to hexa- are used. As di- to deca-polyalcohols, concretely, for instance, diols such as ethylene glycol, diethylene glycol, polyethyleneglycol (trimers to 15-mers of ethylene glycol), propylene glycol, dipropylene glycol, polypropylene glycol (trimers to 15-mers of propylene glycol), 1,3-propanediol, 1,2-propanediol, 1,3-butanediol, 1,4-butanediol, 2-methyl-1,2-propanediol, 2-methyl-1,3-propanediol, 1,2-pentane diol, 1,3-pentane diol, 1,4-pentane diol, 1,5-pentane diol, neopentyl glycol; polyalcohols, such as, glycerin, polyglycerol (dimers to octamers of glycerin, for instance, diglycerin, triglycerin, tetraglycerin and the like), trimethylol alkane (trimethylol ethane, trimethylol propane, trimethylol butane and the like) and dimers to octamers thereof, pentaerythritol and dimers to tetramers thereof, 1,2,4-butane triol, 1,3,5-pentane triol, 1,2,6-hexane triol, 1,2,3,4-butane tetrol, sorbitol, sorbitan, sorbitol glycerin condensation product, adonitol, arabitol, xylitol and mannitol; saccharides such as, xylose, arabinose, ribose, rhamnose, glucose, fructose, galactose, mannose, sorbose, cellobiose, maltose, isomaltose, trehalose and sucrose, and mixtures thereof, or the like, may be cited.

In addition, as partial esters of polyalcohol, compounds in which a portion of the hydroxyl groups on the polyalcohols given as examples in the description of the above-mentioned polyalcohols is hydrocarbyl esterified, and the like, may be cited, among which glycerin monoolate, glycerin diolate, sorbitan monoolate, sorbitan diolate, pentaerythritol monoolate, polyethyleneglycol monoolate and polyglycerol monoolate are preferred.

In addition, as partial ethers of polyalcohol, compounds in which a portion of the hydroxyl groups on the polyalcohols given as examples in the description of the above-mentioned polyalcohols is hydrocarbyl etherified, compounds in which ether linkage is formed by condensation of polyalcohols with each other (sorbitan condensation product and the like) and the like may be given, among which 3-octadecyl oxy-1,2-propanediol, 3-octadecenyl oxy-1,2-propanediol, polyethyleneglycol alkyl ether and the like are preferred.

In addition, a nitrogen compounds having a hydroxyl group, alkanol amines given as examples in the description of amine salts of phosphorus compounds as the (A) constituent, as well as alkanol amides in which the amino group of the alkanol is amidated (diethanol amide and the like) and the like may be cited, among which stearyl diethanolamine, polyethyleneglycol stearylamine, polyethyleneglycol dioleyl amine, hydroxyethyl lauryl amine, oleic acid diethanol amide and the like are preferred.

In the lubricating oil composition of the present invention, the (B) constituent content converted to molybdenum element with the total amount of the composition as the reference is preferably 10 mass ppm or greater, more preferably 30 mass ppm or greater, and even more preferably 100 mass ppm or greater, in addition, preferably 1000 mass ppm or less, more preferably 600 mass ppm or less, and even more preferably 400 mass ppm or less. If the (B) constituent content converted to molybdenum element is less than 10 mass ppm, effects of improvement of antioxidant properties, ability to maintain the base number, cleaning properties at high temperature and resistance against NOx by the combined use of (A) constituent and (B) constituent tend to become insufficient, and in addition, even if 1000 mass ppm is exceeded, the above improvement effects tend not to be obtained commensurate to the increase in the content.

The lubricating oil composition of the present invention may comprise the above base oil for lubricating oil, (A) constituent and (B) constituent only; however, it may further comprise, as necessary, various additives shown below.

The lubricating oil composition of the present invention preferably further comprises (C) a metallic cleanser (hereinafter, may be sometimes referred to as (C) constituent), in order to improve further the acid neutralization properties, cleaning properties at high temperature and anti-wear properties thereof.

As the (C) constituent, for instance, alkali metal sulfonate or alkaline earth metal sulfonate, alkali metal phenate or alkaline earth metal phenate, alkali metal salicylate or alkaline earth metal salicylate, alkali metal phosphonate or alkaline earth metal phosphonate, or mixtures thereof, and the like, may be cited.

As alkali metal or alkaline earth metal sulfonate, more concretely, for instance, alkali metal salts or alkaline earth metal salts, and in particular, magnesium salts and/or calcium salts, of alkyl aromatic sulfonic acids obtained by sulfonation of an alkyl aromatic compound having a molecular weight of 100 to 1500, and preferably 200 to 700, are used preferably, and as alkyl aromatic sulfonic acids, concretely, the so-called petroleum sulfonic acids, synthetic sulfonic acids, and the like, may be cited.

As petroleum sulfonic acids, generally, those obtained by sulfonation of alkyl aromatic compounds of the lubricating oil fraction of a mineral oil, the by-product generated during white oil manufacturing, the so-called mahogany acid, and the like, are used. In addition, as synthetic sulfonic acids, for instance, those obtained by sulfonation, with, serving as the source material, an alkyl benzene having a linear or branched alkyl group generated as a by-product from an alkyl benzene manufacturing plant to be the source material of a cleaner, or obtained by alkylating benzene with a polyolefin, or those obtained by sulfonation of dinonyl naphthalene, and the like, are used. In addition, although there are no particular limitations as sulfonation agents when sulfonating these alkyl aromatic compounds, in general, fuming sulfuric acid and sulfuric acid are used.

As alkali metal or alkaline earth metal phenate, more concretely, alkali metal salts or alkaline earth metal salts, in particular magnesium salts and/or calcium salts of alkyl phenols having at least one linear or branched alkyl group having 4 to 30 carbons, preferably 6 to 18, alkyl phenol sulfides obtained by reacting this alkyl phenol and an elementary sulfur or Mannich reaction products of alkyl phenols obtained by reacting this alkyl phenol and formaldehyde, or the like, are preferably used.

As alkali metal or alkaline earth metal salicylates, more concretely, alkali metal salts or alkaline earth metal salts, in particular magnesium salts and/or calcium salts of alkyl salicylic acids having at least one linear or branched alkyl group having 4 to 30 carbons, preferably 6 to 18, or the like, are preferably used.

In addition, alkali metal or alkaline earth metal sulfonates, alkali metal or alkaline earth metal phenates and alkali metal or alkaline earth metal salicylates not only include neutral salts (normal salts) obtained by reacting alkyl aromatic sulfonic acids, alkyl phenols, alkyl phenol sulfides, Mannich reaction products of alkyl phenols, alkyl salicylic acid, and the like, directly with a metallic base such as oxides and hydroxides of alkali metal or alkaline earth metal, or once they have been turned into alkali metal salts such as sodium salts and potassium salts, by substitution with an alkaline earth metal salt, or the like, but furthermore, basic salts obtained by heating neutral salts (normal salts) thereof and excess alkali metal or alkaline earth metal salts or alkali metal or alkaline earth metal bases (hydroxides or oxides of alkali metal or alkaline earth metal) in the presence of water, and over-based salts (ultra basic salts) obtained by reacting neutral salts (normal salts) with a base such as a hydroxide of alkali metal or alkaline earth metal in the presence of carbon dioxide or boric acid or a borate salt. Note that these reactions are carried out in general, in a solvent (aliphatic hydrocarbon solvent such as hexane, aromatic hydrocarbon solvent such as xylene, base oil for light lubricating oil and the like).

In addition, a metallic cleanser is in general commercialized in a form diluted with base oil for light lubricating oil or the like, and in addition, is available, and in general, using those having a metallic content thereof of 1.0 to 20% by mass, preferably 2.0 to 16% by mass is desirable. In addition, the total base number of metallic cleanser is in general 0 to 500 mgKOH/g, and preferably 20 to 450 mgKOH/g. Note that the total base number referred to herein means the total base number as measured by the perchloric acid method according to 7. in JIS K2501 "Petroleum Products and Lubricants—Determination of Neutralization Number".

In the present invention, one species alone or two or more species in combination selected from sulfonate, phenate, salicylate, or the like of alkali metal or alkaline earth metal, can be used. In the present invention, alkali metal or alkaline earth metal salicylate is particularly preferred as (C) constituent, on the point that friction reduction effect and/or anti-wear effect large point due to low ashing, and the point that long drain intervals properties are excellent.

The metal ratio of (C) constituent is not limited in particular, and those having 20 or less can be used in general; however from the point of the ability to increase further the friction reduction effect and long drain intervals properties, inclusion of one species or two or more species selected from metallic cleansers having a metal ratio of 1 to 10 is preferred. Note that metal ratio referred to herein is represented by the valence of metal element in the metallic cleanser×metal element content (% by mole)/soap group content (% by mole), and metal element means calcium, magnesium and the like, and soap group means sulfonic acid group, salicylic acid group and the like.

As (C) constituent, alkali metal or alkaline earth metal salicylate is particularly preferred on the point of large friction reduction effect due to low ashing, and the point of better long drain intervals properties.

The upper limit value of the (C) constituent content in the lubricating oil composition of the present invention is not limited in particular, and is in general 0.5% by mass or less with the total amount of the composition as the reference; however, in general, it is preferably adjusted according to other additives so that the sulfated ash of the composition becomes 1.0% by mass or less with the total amount of the composition as the reference. From such points of view, the (C) constituent content converted into amount of metal element with the total amount of the composition as the reference, is preferably 0.3% by mass or less, and even more preferably 0.23% by mass or less. In addition, the (C) constituent content is preferably 0.01% by mass or greater, more preferably 0.02% by mass or greater, and even more preferably 0.15% by mass or greater. Note that a (B) constituent content of less than 0.01% by mass is not desirable, as long drain intervals capabilities such as cleaning properties at high temperature, oxidation stability, ability to maintain the base number become difficult to obtain.

In addition, the mass ratio (M/Mo) of metal (M) contained in the (C) constituent and molybdenum (Mo) contained in the (B) constituent is preferably 0.1 to 500, more preferably 2 to 100, even more preferably 3 to 60, all the more preferably 5 to 50, and particularly preferably 10 to 40.

In addition, the lubricating oil composition of the present invention preferably further comprises (D) ashless dispersant (hereinafter, may sometimes be referred to as (D) constituent).

Any ashless dispersant used in a lubricating oil can be used as the (D) constituent, for instance, nitrogen compounds containing at least one linear or branched alkyl group or alkenyl group having 40 to 400 carbons within the molecule, or derivatives thereof, or modification products of alkenyl succinimide, and the like, may be cited. Any one species, or two species or more selected from these can be mixed.

The number of carbons of this alkyl group or alkenyl group is 40 to 400, and preferably 60 to 350. If the number of carbons of the alkyl group or alkenyl group is less than 40, the solubility of the compound with respect to the base oil for lubricating oil decreases, on the other hand, if the number of carbons of the alkyl group or alkenyl group exceeds 400, the low temperature fluidity of the lubricating oil composition deteriorates, such that neither is desirable. Although this alkyl group or alkenyl group may be linear or branched, concretely, branched alkyl groups and branched alkenyl groups derived from oligomers of olefins such as propylene, 1-butene and isobutylene, and co-oligomers of ethylene and propylene, and the like, may be cited as preferred ones.

As specific examples of (D) constituent, for instance, the following compounds may be cited. One species, or two or more species of compounds selected from among these can be used.

(D-1) succinimide having at least one alkyl group or alkenyl group having 40 to 400 carbons within the molecule, or derivatives thereof (D-2) benzylamine having at least one alkyl group or alkenyl group having 40 to 400 carbons within the molecule, or derivatives thereof (D-3) polyamine having at least one alkyl group or alkenyl group having 40 to 400 carbons within the molecule, or derivatives thereof.

As the above-mentioned (D-1) succinimide, more concretely, the compounds represented by the following General Formula (7) or (8), and the like, can be given as examples.

[Chemical formula 11]

(7)

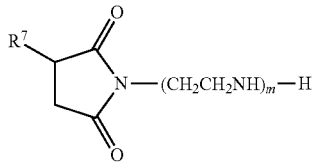

wherein $R^7$ represents an alkyl group or an alkenyl group having a number of carbons of 40 to 400, and preferably 60 to 350, and m represents an integer from 1 to 5, and preferably from 2 to 4.

[Chemical formula 12]

(8)

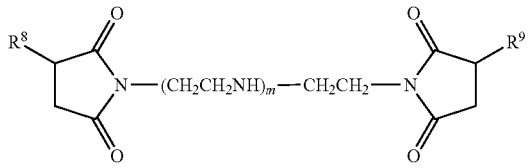

herein $R^8$ and $R^9$ each separately represent an alkyl group or an alkenyl group having a number of carbons of 40 to 400, preferably 60 to 350, and even more preferably a polybutenyl group, and m represents an integer from 0 to 4, and preferably from 1 to 3.

Note that succinimides include so-called mono type succinimides represented by Formula (7), in which a succinic anhydride is added at one extremity of a polyamine, and so-called bis type succinimides represented by Formula (8), in which succinic anhydrides are added at both extremities of a polyamine, and in the lubricating oil composition of the present invention, only one of these may be included, or mixtures thereof may be included.

There is no particular limitation in the preparation of the above-mentioned succinimide, which can be obtained by, for instance, reacting a combination having an alkyl group or an alkenyl group having 40 to 400 carbons with maleic anhydride at 100 to 200° C. to obtain an alkyl or alkenyl succinic acid which is then reacted with a polyamine. As polyamine, concretely, diethylene triamine, triethylene tetramine, tetraethylene pentamine, and pentaethylene hexamine, and the like, can be given as examples.

As the above-mentioned (D-2) benzylamine, more concretely, the compound represented by the following General Formula (7), and the like, can be given as examples.

[Chemical formula 13]

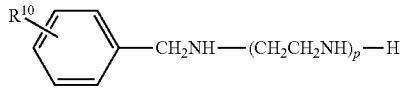

(9)

wherein $R^{10}$ represents an alkyl group or an alkenyl group with a number of carbons of 40 to 400, and preferably 60 to 350, and p represents an integer from 1 to 5, and preferably from 2 to 4.

There is no limitation whatsoever in the preparation method for the above-mentioned benzylamine, which can be obtained, for instance, by reacting a polyolefin such as propylene oligomer, polybutene, and ethylene-α-olefin copolymer with a phenol to obtain an alkyl phenol, and then, reacting thereto formaldehyde and a polyamine such as diethylene triamine, triethylene tetramine, tetraethylene pentamine, and pentaethylene hexamine by the Mannich reaction.

As the above-mentioned (D-3) polyamine, more concretely, the compounds represented by the following General Formula (10), and the like, can be given as examples.

$$R^{11}—NH—(CH_2CH_2NH)_q—H \quad (10)$$

[in Formula (10), $R^{10}$ represents an alkyl group or an alkenyl group with a number of carbons of 40 to 400, and preferably 60 to 350, and q represents an integer from 1 to 5, and preferably from 2 to 4.]

There is no limitation whatsoever in the preparation method for the above-mentioned polyamine, which can be obtained, for instance, by chlorinating a polyolefin such as propylene oligomer, polybutene, and ethylene-α-olefin copolymer, then reacting thereto ammoniac, or polyamine such as ethylene diamine, diethylene triamine, triethylene tetramine, tetraethylene pentamine, and pentaethylene hexamine.

In addition, as the nitrogen-containing compound derivatives given as one example of the (D) constituent, concretely, for instance, the so-called acid modification compounds obtained by action of a mono carboxylic acid having 1 to 30 carbons (fatty acid and the like) or a polycarboxylic acid having 2 to 30 carbons such as oxalic acid, phthalic acid, trimellitic acid or pyromellitic acid, onto the above nitrogen-containing compound, and neutralization or amidation of a portion or the entirety of the remaining amino groups and/or imino groups; the so-called boron modification compounds obtained by action of boric acid onto the above nitrogen-containing compound, and neutralization or amidation of a portion or the entirety of the remaining amino groups and/or imino groups; sulfur modification compounds obtained by action of a sulfur compound onto the above nitrogen-containing compound; and modification compounds obtained by combining two or more modifications selected from acid modification, boron modification and sulfur modification, onto the above nitrogen-containing compound; and the like, may be cited. Among these derivatives, boron modification compounds of alkenyl succinimide are effective, as they have excellent heat resistance and antioxidant properties, and in the lubricating oil composition of the present invention, further increase the ability to maintain the base number and cleaning properties at high temperature.

When including the (D) constituent in the lubricating oil composition of the present invention, the content thereof is, in general 0.01 to 20% by mass with the total amount of lubricating oil composition as the reference, and preferably 0.1 to 10% by mass. If the (D) constituent content is less than 0.01% by mass, effects with regard to the ability to maintain the base number at high temperature is low, on the other hand, if exceeding 20% by mass, the low temperature fluidity of the lubricating oil composition deteriorates widely, such that neither is desirable.

In addition, the lubricating oil composition of the present invention preferably further includes (E) an antioxidant (hereinafter, sometimes (E) constituent). This further increases the antioxidant properties of the lubricating oil composition, allowing the ability to maintain the base number and cleaning properties at high temperature of the present invention to be further increased.

As the (E) constituent, those [antioxidants] generally used in lubricating oil, such as, phenol series antioxidant and amine series antioxidant, and metal series antioxidant can be used.

As phenol series antioxidants, for instance, 4,4'-methylene bis(2,6-di-tert-butyl phenol), 4,4'-bis(2,6-di-tert-butyl phenol), 4,4'-bis(2-methyl-6-tert-butyl phenol), 2,2'-methylene bis(4-ethyl-6-tert-butyl phenol), 2,2'-methylene bis(4-methyl-6-tert-butyl phenol), 4,4'-butylidene bis(3-methyl-6-tert-butyl phenol), 4,4'-isopropylidene bis(2,6-di-tert-butyl phenol), 2,2'-methylene bis(4-methyl-6-nonyl phenol), 2,2'-isobutylidene bis(4,6-dimethyl phenol), 2,2'-methylene bis (4-methyl-6-cyclohexyl phenol), 2,6-di-tert-butyl-4-methyl phenol, 2,6-di-tert-butyl-4-ethyl phenol, 2,4-dimethyl-6-tert-butyl phenol, 2,6-di-tert-α-dimethylamino-p-cresol, 2,6-di-tert-butyl-4(N,N-dimethylamino methyl phenol), 4,4'-thio bis(2-methyl-6-tert-butyl phenol), 4,4'-thio bis(3-methyl-6-tert-butyl phenol), 2,2'-thio bis(4-methyl-6-tert-butyl phenol), bis(3-methyl-4-hydroxy-5-tert-butyl benzyl)sulfide, bis (3,5-di-tert-butyl-4-hydroxy benzyl)sulfide, 2,2'-thiodiethylene bis[3-(3,5-di-tert-butyl-4-hydroxyphenyl) propionate], tridecyl-3-(3,5-di-tert-butyl-4-hydroxyphenyl) propionate, pentaerythrityl-tetrakis[3-(3,5-di-tert-butyl-4-hydroxyphenyl)propionate], octyl-3-(3,5-di-tert-butyl-4-hydroxyphenyl)propionate, octadecyl-3-(3,5-di-tert-butyl-4-hydroxyphenyl)propionate, 3-methyl-5-tert-butyl-4-hydroxyphenyl substituted fatty acid esters, and the like, can be given as preferred examples. These may be used [as] one species alone, or may be used by mixing two or more species.

As amine series antioxidants, for instance, phenyl-α-naphthyl amine, alkyl phenyl-α-naphthyl amine, and dialkyl diphenylamine can be cited. These may be used by mixing two or more species.

Furthermore, the above-mentioned phenol series antioxidants and amine series antioxidants may be used in combination.

When including the (E) constituent in the lubricating oil composition of the present invention, the content thereof, with the total amount of lubricating oil composition as the reference, is in general 5.0% by mass or less, preferably 3.0% by mass or less, and more preferably 2.5% by mass or less. If the content thereof exceeds 5.0% by mass, sufficient antioxidant properties commensurate with the content cannot be obtained, which is thus not desirable. On the other hand, in order to further increase the ability to maintain the base number and cleaning properties at high temperature in the course of lubricating oil degradation, the content thereof, with the total amount of lubricating oil composition as the reference, is preferably 0.1% by mass or greater, and preferably 1% by mass or greater.

Note that, the (A) constituent of the present invention includes compounds that do not dissolve in base oil for lubricating oil or compound that have low solubility (for instance, zinc dialkyl phosphate and the like, which exist in solid state at ordinary temperature), and when such compounds are used as (A) constituent, it is particularly desirable from the points of improving the solubility of the (A) constituent in the base oil for lubricating oil and shortening the preparation time for the lubricating oil composition, to mix a nitrogen-containing compound (for instance, an amine compound as the (D) constituent, an amine series antioxidant as the (E) constituent, or a mixture thereof) and the (A) constituent, carry out dissolution or reaction, and mixing the obtained solute or reaction product as an oil-soluble additive into the lubricating oil composition. As a preparation example of such oil-soluble additives, they are obtained, for instance, by mixing the (A) constituent and the above-mentioned nitrogen-containing compound, preferably in an organic solvent such as hexane, toluene or decalin, at 15 to 150° C., preferably at 30 to 120° C., and particularly preferably at 40 to 90° C., for 10 minutes to 5 hours, preferably 20 minutes to 3 hours, and particularly preferably 30 minutes to 1 hour, carry out the dissolution or the reaction, and evaporating the solvent by distillation at reduced pressure or the like.

In order to further increase the capabilities thereof, any additive generally used in lubricating oil can be added to the lubricating oil composition of the present invention according to the purpose. As such additives, for instance, additives such as anti-wear agents, friction adjusters, viscosity index improvers, corrosion inhibitors, anti-rusts, anti-emulsifying agents, metal inactivators, anti-foaming agents, and pigments, or the like, can be cited.

As anti-wear agents, for instance, sulfur-containing compounds such as disulphide, sulfide olefin, sulfide oil fat, metal salts of dithiophosphoric acid (zinc salts, molybdenum salts and the like), metal salts of dithio carbamic acid (zinc salts, molybdenum salts and the like), dithiophosphate and derivatives thereof (reaction products of dithiophosphate with olefin cyclopentadiene, (methyl)methacrylic acid, propionic acid and the like; in the case of propionic acid, circumstance those with addition at the β position are preferred), trithiophosphate, dithiocarbamate, and the like, may be cited. These can be included in general, in a range of 0.005 to 5% by mass as long as the capabilities of the composition of the present invention are not compromised widely, and from the points of sulfur content reduction and long drain intervals properties, and the content thereof in values converted into sulfur is preferably 0.1% by mass or less, and more preferably 0.05% by mass or less.

As friction adjusters, any compound generally used as friction adjuster for lubricating oil can be used, for instance, molybdenum series friction adjusters such as molybdenum disulfide, molybdenum dithio carbamate and molybdenum dithio phosphate, amine compounds having at least one linear chain alkyl group or linear chain alkenyl group having 6 to 30 carbons within the molecule, and in particular an alkyl group or alkenyl group having 6 to 30 carbons, ashless friction adjusters such as fatty acid esters, fatty acid amides, fatty acids, aliphatic alcohols, aliphatic ethers, hydrazides (oleyl hydrazide and the like), semicarbazide, urea, ureide, biuret, and the like, may be cited. The content of these friction adjusters is in general 0.1 to 5% by mass.

As viscosity index improvers, concretely, so-called non-dispersive viscosity index improvers, such as, polymers or copolymers of one species or two or more species of monomers selected from various methacrylic acid esters, or hydrogenates thereof, and the like, or so-called dispersive viscosity index improvers from the copolymerization of various methacrylic acid esters further containing a nitrogen compound, non-dispersive or dispersive ethylene-α-olefin copolymers (as α-olefins, propylene, 1-butene, 1-pentene, and the like, can be given as examples) or hydrides thereof, poly isobutylene or hydrogenates thereof, hydrides of styrene-diene copolymer, styrene-anhydrous maleate copolymer and polyalkyl styrene, and the like, may be cited.

The molecular weights of these viscosity index improvers need to be selected taking shear stability into account. Concretely, the number average molecular weight used for a viscosity index improver is, for instance, in general 5,000 to 1,000,000 and preferably 100,000 to 900,000 in the case of dispersive and non-dispersive polymetacrylates, in general 800 to 5,000 and preferably 1,000 to 4,000 in the case of poly isobutylene or hydrides thereof, and in general 800 to 500,000 and preferably 3,000 to 200,000 in the case of ethylene-α-olefin copolymers or hydrides thereof.

In addition, when ethylene-α-olefin copolymers or hydrides thereof are used among these viscosity index improvers, a lubricating oil composition with particularly excellent shear stability can be obtained. One species or two or more species of compounds suitably selected from the above-mentioned viscosity index improvers can be included in adequate amounts. The content of viscosity index improver with the lubricating oil composition as the reference is in general 0.1 to 20% by mass.

As corrosion inhibitors, for instance, benzotriazole series, tolyl triazole series, thiadiazole series, and imidazole series compounds, and the like, may be cited.

As anti-rusts, for instance, petroleum sulfonate, alkyl benzene sulfonate, dinonyl naphthalene sulfonate, alkenyl succinic acid ester, and polyalcohol ester, and the like, may be cited.

As anti-emulsifying agents, for instance, polyalkylene glycol series nonionic surfactants, such as, polyoxyethylene alkyl ether, polyoxyethylene alkyl phenyl ether, and polyoxyethylene alkyl naphthyl ether, and the like, may be cited.

As metal inactivators, for instance, imidazoline, pyrimidine derivative, alkyl thiadiazole, mercapto benzothiazole, benzotriazole or derivatives thereof, 1,3,4-thiadiazole polysulfide, 1,3,4-thiaziazolyl-2,5-bis dialkyl dithio carbamate, 2-(alkyldithio)benzoimidazole, and P-(o-carboxybenzylthio)propione nitrile, and the like, may be cited.

As antifoaming agents, for instance, silicone, fluorosilicone, and fluoroalkyl ether, and the like, may be cited.

When including these additives in the lubricating oil composition of the present invention, the contents thereof with the total amount of lubricating oil composition as the reference are selected in the ranges of 0.005 to 5% by mass for each of the corrosion inhibitors, anti-rusts and anti-emulsifying agents, 0.005 to 1% by mass for metal inactivators, and 0.0005 to 1% by mass for antifoaming agents.

By selecting the base oil for lubricating oil, the (A) constituent, the (B) constituent, the (C) constituent and the various additives, the lubricating oil composition of the present invention can also be made into a low sulfur lubricating oil composition having a sulfur content within the composition of 0.3% by mass or less, preferably 0.2% by mass or less, and more preferably 0.1% by mass or less with excellent long drain intervals properties.

In addition, in order to increase the long drain intervals properties of the lubricating oil composition of the present invention, and alleviate the detrimental effects on the emission gas post-processing device as much as possible, the sulfated ash of the composition is preferably brought to 1.0% by mass or less, more preferably brought to 0.8% by mass or less, more preferably brought to 0.6% by mass or less, and particularly preferably brought to 0.5% by mass or less, by optimizing the (A) constituent, the (B) constituent, the (C) constituent and other additives containing metal, and the contents thereof. Herein, sulfated ash indicates a value measured by the method defined in, JIS K 2272, 5. "Determination of Sulfated Ash", and mainly originating from the metal-containing additives.

The lubricating oil composition of the present invention has excellent long drain intervals properties (oxidation stability, ability to maintain the base number, cleaning properties at high temperature, and resistance against NOx). Therefore, it can be used preferably as lubricating oil for internal combustion engines, such as, gasoline engines, diesel engine and gas engine for two-wheeled vehicles, four-wheeled vehicles, power generation, marine use, and the like, and as it is low sulfur and low ash, it is in particularly suited for internal combustion engines fitted with an emission gas post-processing device. In addition, it can be used in particularly preferably as a lubricating oil for internal combustion engines using low sulfur fuels, for instance, gasoline, light oil and kerosene with a sulfur content of 50 mass ppm or less, more preferably 30 mass ppm or less, and particularly preferably 10 mass ppm or less, or fuels with a sulfur content of 1 mass ppm or less (LPG, natural gas, hydrogen substantially not containing sulfur content, dimethyl ether, alcohol, GTL (gas-to-liquid) and the like).

In addition, the lubricant composition of the present invention can also be used suitably as lubricating oil requiring oxidation stability, for instance, lubricating oils such as lubricating oils for drive-train such as automatic or manual transmission, grease, wet type brake oil, hydraulic actuation oil, turbine oil, compressor oil, bearing oil and refrigerator oil.

EXAMPLES

Hereinafter, the present invention will be described more concretely based on examples and comparative examples; however, the present invention is not limited in any way to the following examples.

Examples 1 to 10, Comparative Examples 1 to 6

In Examples 1 to 10 and Comparative Examples 1 to 6, using the base oils for lubricating oil and additives respectively shown below, lubricating oil compositions having the compositions shown in Tables 1 to 4 were prepared. In Tables 1 to 4 are shown together the sulfur contents, the phosphorus contents and the molybdenum contents (all values converted to element) of the lubricating oil composition obtained in each example or comparative example.

(Base Oils)

Base oil 1: hydrogenated purified mineral oil (kinematic viscosity at 100° C.: 5.3 $mm^2/s$; viscosity index: 125; sulfur content: 0.001% by mass or less)

(Phosphorus Compounds)

A1: zinc di-n-butyl phosphate (phosphorus content: 13.2% by mass; sulfur content: 0% by mass; zinc content: 13% by mass)

A2: zinc dithiophosphate (alkyl group: sec-butyl group/hexyl group; phosphorus content: 7.2% by mass; sulfur content: 15.2% by mass; zinc content: 7.8% by mass)

(Organic Molybdenum Compound)

B1: di(2-ethyl hexyl)molybdenum phosphate (molybdenum salt of phosphorus compound represented by General Formula (4) with n=1; molybdenum content: 6.5% by mass; phosphorus content: 4.6% by mass; sulfur content: 0% by mass)

B2: ditridecyl amine complex of molybdenum (molybdenum content: 9.7% by mass; sulfur content: 0% by mass)

B3: molybdenum salt of 2-ethyl hexanoic acid (molybdenum content: 15% by mass; sulfur content: 0% by mass)

B4: molybdenum ester of glycerin monoolate (molybdenum content: 1.2% by mass; sulfur content: 0% by mass)

B5: di(2-ethyl hexyl) molybdenum dithio carbamate (molybdenum content: 4.5% by mass; sulfur content: 5.0% by mass)

B6: di(2-ethyl hexyl)molybdenum dithio phosphate (molybdenum content: 9.0% by mass; sulfur content: 10.5% by mass; phosphorus content: 3.3% by mass)

(Metallic Cleansers)

C1: calcium salicylate (base number: 170 mg KOH/g; calcium content: 6.1% by mass; metal ratio: 2.7)

(Ashless Dispersants)

D1: mixture (mass ratio 1:4) of polybutenyl succinimide (number average molecular weight of poly butenyl group: 1300, nitrogen fraction: 1.8% by mass) and boronated product thereof (nitrogen fraction: 0.6% by mass; boron fraction: 0.77% by mass)

(Antioxidants)

E1: mixture (mixing ratio: 1:1 (mass ratio)) of octyl-3-(3,5-di-tert-butyl-4-hydroxyphenyl)propionate and dialkyl diphenyl amine (Viscosity Index Improvers)

F1: ethylene-propylene copolymer series viscosity index improver (weight average molecular weight: 150,000)

(Anti-Emulsifying Agents)

G1: polyalkylene glycol series anti-emulsifying agent.

Hereinafter, the following tests were performed using each lubricating oil composition of Examples 1 to 10 and Comparative Examples 1 to 6.

[NOx absorption test] Changes over time of the base number (hydrochloric acid method) and acid number were measured when NOx-containing gas was blown into test oil methods according to Proceedings of JAST Tribology Conference 1992, 10, 465, for forced degradation. The test temperature in the present test was 140° C., and the NOx concentration in the NOx-containing gas was 1185 ppm. The base numbers and acid numbers 48 hours after or 72 hours after starting blowing NOx gas are shown in Tables 1 to 4. In the tables, a smaller decrease in the base number, or a smaller increase in the acid number, indicates a long drain oil with a higher base number maintenance capability and a longer usable time, even in the presence of NOx, such as used in internal combustion engines.

[Hot Tube Test] Hot tube tests were performed according to JPI-5S-5599, at the two conditions of 300° C. or 310° C. Rating was 10 points for colorless transparency (no dirt), and 0 points for black opacity, and standard tubes created beforehand grading there between by one were referred to for the evaluation. The obtained results are shown in Tables 1 to 4. If the rating is 6 or greater at 290° C., this has excellent cleaning properties as lubricating oil for conventional gasoline engine and for diesel engine; however as lubricating oil for gas engine, demonstration of excellent cleaning properties at 300° C. or higher in the present test is desirable.

TABLE 1

| | | | Example 1 | Example 2 | Example 3 | Example 4 | Example 5 |
|---|---|---|---|---|---|---|---|
| Base oil for lubricant oil [mass %] | | Base oil 1 | Residue | Residue | Residue | Residue | Residue |
| Phosphorus compound [mass %] (amount converted into phosphorus element [mass %]) | | A1 | 0.53 (0.07) | 0.60 (0.08) | 0.23 (0.03) | 0.60 (0.08) | 1.14 (0.15) |
| Organic molybdenum compound [mass %] (amount converted into molybdenum element [mass %]) | | B1 | 0.10 (0.005) | — | — | — | — |
| | | B2 | — | 0.05 (0.005) | 0.10 (0.010) | 0.10 (0.010) | 0.10 (0.010) |
| | | B3 | — | — | — | — | — |
| | | B4 | — | — | — | — | — |
| Metallic cleanser [mass %] (amount converted into metal element [mass %]) | | C1 | 3.00 (0.18) | 3.00 (0.18) | 3.00 (0.18) | 3.00 (0.18) | 3.00 (0.18) |
| Ashless dispersant [mass %] | | D1 | 5.00 | 5.00 | 5.00 | 5.00 | 5.00 |
| Antioxidant [mass %] | | E1 | 2.00 | 2.00 | 2.00 | 2.00 | 2.00 |
| Viscosity index improver [mass %] | | F1 | 4.00 | 4.00 | 4.00 | 4.00 | 4.00 |
| Anti emulsifying agent [mass %] | | G1 | 0.01 | 0.01 | 0.01 | 0.01 | 0.01 |
| Sulfur content [mass %] | | | 0.01 | 0.01 | 0.01 | 0.01 | 0.01 |
| Phosphorus content [mass %] | | | 0.08 | 0.08 | 0.03 | 0.08 | 0.15 |
| Molybdenum content [mass %] | | | 50 | 50 | 100 | 100 | 100 |
| Mass ratio (M/Mo) of metal (M) contained in the metallic cleanser and molybdenum (Mo) contained in organic molybdenum compound | | | 36 | 36 | 18 | 18 | 18 |
| NOx absorption test | Base number residual ratio[%] | 48 hours later | 26 | 28 | 31 | 30 | 31 |
| | | 72 hours later | 13 | 18 | 23 | 22 | 21 |
| | Acid number [mg KOH/g] | 48 hours later | 1.3 | 0.9 | 1.2 | 1.1 | 1.3 |
| | | 72 hours later | 2.1 | 1.1 | 2.0 | 1.9 | 2 |
| Hot tube test (score) | | 300° C. | 9 | 10 | 10 | 10 | 10 |
| | | 310° C. | 5 | 9 | 9 | 9 | 9 |

TABLE 2

| | | | Example 6 | Example 7 | Example 8 | Example 9 | Example 10 |
|---|---|---|---|---|---|---|---|
| Base oil for lubricant oil [% by mass] | | Base oil 1 | Residue | Residue | Residue | Residue | Residue |
| Phosphorus compound [% by mass] (amount converted into phosphorus element [% by mass]) | | A1 | 0.60 (0.08) | 0.60 (0.08) | 0.60 (0.08) | 0.60 (0.08) | 0.60 (0.08) |
| Organic molybdenum compound [% by mass] (amount converted into molybdenum element [% by mass]) | | B1 | — | — | — | — | — |
| | | B2 | 0.15 (0.015) | 0.30 (0.030) | 0.50 (0.050) | — | — |
| | | B3 | — | — | — | 0.10 (0.015) | — |
| | | B4 | — | — | — | — | 0.90 (0.010) |
| Metallic cleanser [% by mass] (amount converted into metal element [% by mass]) | | C1 | 3.00 (0.18) | 3.00 (0.18) | 3.00 (0.18) | 3.00 (0.18) | 3.00 (0.18) |
| Ashless dispersant [% by mass] | | D1 | 5.00 | 5.00 | 5.00 | 5.00 | 5.00 |
| Antioxidant [% by mass] | | E1 | 2.00 | 2.00 | 2.00 | 2.00 | 2.00 |
| Viscosity index improver [% by mass] | | F1 | 4.00 | 4.00 | 4.00 | 4.00 | 4.00 |
| Anti emulsifying agent [% by mass] | | G1 | 0.01 | 0.01 | 0.01 | 0.01 | 0.01 |
| Sulfur content [% by mass] | | | 0.01 | 0.01 | 0.01 | 0.01 | 0.01 |
| Phosphorus content [% by mass] | | | 0.08 | 0.08 | 0.03 | 0.08 | 0.08 |
| Molybdenum content [% by mass] | | | 150 | 300 | 500 | 150 | 100 |
| Mass ratio (M/Mo) of metal (M) contained in the metallic cleanser and molybdenum (Mo) contained in organic molybdenum compound | | | 12 | 6 | 3.6 | 12 | 18 |
| NOx absorption test | Base number residual ratio[%] | 48 hours later | 30 | 33 | 35 | 26 | 26 |
| | | 72 hours later | 24 | 24 | 25 | 13 | 15 |
| | Acid number [mg KOH/g] | 48 hours later | 1.4 | 1.5 | 2.7 | 1.3 | 1.5 |
| | | 72 hours later | 2.4 | 3 | 3.25 | 2.1 | 2.8 |
| Hot tube test (score) | | 300° C. | 10 | 5 | — | 8.5 | 10 |
| | | 310° C. | 5 | — | — | 2 | 9 |

TABLE 3

| | | Comparative Example 1 | Comparative Example 2 | Comparative Example 3 |
|---|---|---|---|---|
| Base oil for lubricant oil [% by mass] | Base oil 1 | Residue | Residue | Residue |
| Phosphorus compound [% by mass] (amount converted into phosphorus element [% by mass]) | A1 | 0.60 (0.08) | 0.60 (0.08) | 0.60 (0.08) |

TABLE 3-continued

| | | | Comparative Example 1 | Comparative Example 2 | Comparative Example 3 |
|---|---|---|---|---|---|
| Organic molybdenum compound [% by mass] | | B5 | — | 0.30 | 0.60 |
| (amount converted into molybdenum element [% by mass]) | | | | (0.015) | (0.030) |
| | | B6 | — | — | — |
| Metallic cleanser [% by mass] | | C1 | 3.00 | 3.00 | 3.00 |
| (amount converted into metal element [% by mass]) | | | (0.18) | (0.18) | (0.18) |
| Ashless dispersant [% by mass] | | D1 | 5.00 | 5.00 | 5.00 |
| Antioxidant [% by mass] | | E1 | 2.00 | 2.00 | 2.00 |
| Viscosity index improver [% by mass] | | F1 | 4.00 | 4.00 | 4.00 |
| Anti emulsifying agent [% by mass] | | G1 | 0.01 | 0.01 | 0.01 |
| Sulfur content [% by mass] | | | 0.01 | 0.025 | 0.04 |
| Phosphorus content [% by mass] | | | 0.08 | 0.08 | 0.08 |
| Molybdenum content [% by mass] | | | 0 | 150 | 300 |
| Mass ratio (M/Mo) of metal (M) contained in the metallic cleanser and molybdenum (Mo) contained in organic molybdenum compound | | | — | 12 | 6 |
| NOx absorption test | Base number residual ratio[%] | 48 hours later | 22 | 22 | 20 |
| | | 72 hours later | 4 | 6 | 0 |
| | Acid number [mg KOH/g] | 48 hours later | 2.4 | 1.8 | 2.7 |
| | | 72 hours later | 6.3 | 3.3 | 3.3 |
| Hot tube test (score) | | 300° C. | 8 | 0 | 0 |
| | | 310° C. | 0 | 0 | 0 |

TABLE 4

| | | | Comparative Example 4 | Comparative Example 5 | Comparative Example 6 |
|---|---|---|---|---|---|
| Base oil for lubricant oil [% by mass] | | Base oil 1 | Residue | Residue | Residue |
| Phosphorus compound [% by mass] | | A1 | 0.60 | — | — |
| (amount converted into phosphorus element [% by mass]) | | | (0.08) | | |
| | | A2 | — | 1.05 | 1.05 |
| | | | | (0.08) | (0.08) |
| Organic molybdenum compound [% by mass] | | B2 | — | — | 0.10 |
| (amount converted into molybdenum element [% by mass]) | | | | | (0.010) |
| | | B5 | — | 0.60 | — |
| | | | | (0.030) | |
| | | B6 | 0.16 | — | — |
| | | | (0.015) | | |
| Metallic cleanser [% by mass] | | C1 | 3.00 | 3.00 | 3.00 |
| (amount converted into metal element [% by mass]) | | | (0.18) | (0.18) | (0.18) |
| Ashless dispersant [% by mass] | | D1 | 5.00 | 5.00 | 5.00 |
| Antioxidant [% by mass] | | E1 | 2.00 | 1.00 | 1.00 |
| Viscosity index improver [% by mass] | | F1 | 4.00 | 4.00 | 4.00 |
| Anti emulsifying agent [% by mass] | | G1 | 0.01 | 0.01 | 0.01 |
| Sulfur content [% by mass] | | | 0.025 | 0.185 | 0.17 |
| Phosphorus content [% by mass] | | | 0.08 | 0.08 | 0.08 |
| Molybdenum content [% by mass] | | | 150 | 300 | 100 |
| NOx absorption test | Base number residual ratio[%] | 48 hours later | 20 | 0 | 0 |
| | | 72 hours later | 6 | 0 | 0 |
| | Acid number [mg KOH/g] | 48 hours later | 2.3 | 2.1 | 2.2 |
| | | 72 hours later | 3.6 | 4.0 | 4.2 |
| Hot tube test (score) | | 300° C. | 0 | 0 | 0 |
| | | 310° C. | 0 | 0 | 0 |

[Test for evaluating compatibility with respect to emission gas post-processing device] With respect to a diesel fuel with a sulfur content of 1 mass ppm or less, 0.1% by mass of the lubricating oil composition of Example 4 was added to prepare a test fuel. Using this test fuel and the lubricating oil composition of Example 4 as engine oil, under the conditions of 2400 rpm rotation speed, ½ charge and 100 hours driving time, a single cylinder general purpose diesel engine fitted with an external regeneration type DPF was driven, and compatibility of the lubricating oil composition with respect to DPF was evaluated.

In addition, as a comparative test, a similar test to above was carried out, using a test fuel [resulting] from the addition of 0.1% by mass of lubricating oil composition of Comparative Example 5 with respect to a diesel fuel having a sulfur content of 1 mass ppm or less, and the lubricating oil composition of Comparative Example 5 as engine oil.

In the above test, when the lubricating oil composition of Comparative Example 5 was used, clogging of DPF was observed. This clogging of DPF is thought to originate from the generation of $CaSO_4$. On the other hand, when the lubricating oil composition of Example 4 was used, clogging properties of the DPF improved compared to when the lubricating oil composition of Comparative Example 5 was used, and at the same time, regeneration of DPF after the drive was found to be easy.

The invention claimed is:

1. A lubricating oil composition, comprising:

a base oil for lubricating oil;

(A) at least one species selected from metal salts and amine salts of phosphorus compounds represented by the following General Formula (1) or (2) excluding molybdenum salts; and (B) an organic molybdenum compound not containing sulfur as a constituent element; and (C) a metallic cleanser;

the mass ratio M/Mo being from 10 to 40, wherein M represents metal contained in the metallic cleanser and Mo represents molybdenum contained in the organic molybdenum compound

[Chemical formula 1]

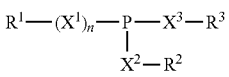

(1)

wherein $R^1$ represents a hydrocarbon group having 1 to 30 carbons, $R^2$ and $R^3$ may be identical or different, each representing a hydrogen atom or a hydrocarbon group having 1 to 30 carbons, $X^1$, $X^2$ and $X^3$ may be identical or different, each representing an oxygen atom or a sulfur atom, and n represents 0 or 1, at least one of $X^2$ and $X^3$ representing an oxygen atom when n represents 0, and at least one of $X^1$, $X^2$ and $X^3$ representing an oxygen atom when n represents 1,

[Chemical formula 2]

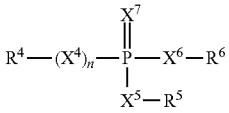

(2)

wherein $R^4$ represents a hydrocarbon group having 1 to 30 carbons, $R^5$ and $R^6$ may be identical or different, each representing a hydrogen atom or a hydrocarbon group having 1 to 30 carbons, $X^4$, $X^5$, $X^6$ and $X^7$ may be identical or different, each representing an oxygen atom or a sulfur atom, and n represents 0 or 1, at least two of $X^5$, $X^6$ and $X^7$ representing oxygen atoms when n represents 0, and at least three of $X^4$, $X^5$, $X^6$ and $X^7$ representing oxygen atoms when n represents 1.

2. The lubricating oil composition according to claim 1, used for an internal combustion engine using a fuel having a sulfur content of less than 100 mass ppm.

3. The lubricating oil composition according to claim 1, wherein as said (A) constituent, at least one species selected from the phosphorus compounds represented by the following General Formula (3) or (4) and metal salts thereof (excluding molybdenum salts),

[Chemical formula 3]

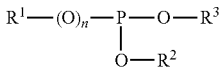

(3)

wherein $R^1$ represents a hydrocarbon group having 1 to 30 carbons, $R^2$ and $R^3$ may be identical or different, each representing a hydrogen atom or a hydrocarbon group having 1 to 30 carbons, and n represents 0 or 1,

[Chemical formula 4]

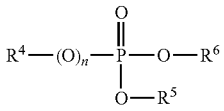

(4)

wherein $R^4$ represents a hydrocarbon group having 1 to 30 carbons, $R^5$ and $R^6$ may be identical or different, each representing a hydrogen atom or a hydrocarbon group having 1 to 30 carbons, and n represents 0 or 1.

4. The lubricating oil composition according to claim 1, comprising as said (B) constituent, at least one species selected from molybdenum-amine complexes, molybdenum salts of organic acids and molybdenum salts of alcohols.

5. The lubricating oil composition according to claim 1, wherein the content of the additive containing sulfur as a constituent element is 0.1% by mass or less when converted to sulfur element based on the total amount of the composition.

6. The lubricating oil composition according to claim 1, wherein the sulfur content of said base oil for lubricating oil is 0.005% by mass or less based on the total amount of the base oil for lubricating oil.

* * * * *

UNITED STATES PATENT AND TRADEMARK OFFICE

CERTIFICATE OF CORRECTION

PATENT NO. : 8,415,282 B2
APPLICATION NO. : 11/663760
DATED : April 9, 2013
INVENTOR(S) : Yagishita It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1211 days.

Signed and Sealed this
Twenty-fourth Day of February, 2015

Michelle K. Lee

Michelle K. Lee
*Deputy Director of the United States Patent and Trademark Office*